US005898934A

United States Patent [19]

Hunter et al.

[11] Patent Number: 5,898,934

[45] Date of Patent: May 4, 1999

[54] NECK ENTRY WETSUIT

[75] Inventors: John D. Hunter; Bruce Y. Moore, both of Santa Cruz, Calif.

[73] Assignee: O'Neill, Inc., Santa Cruz, Calif.

[21] Appl. No.: 09/060,341

[22] Filed: Apr. 14, 1998

Related U.S. Application Data

[63] Continuation-in-part of application No. 08/819,964, Mar. 18, 1997, abandoned, and a continuation-in-part of application No. 08/958,648, Oct. 27, 1997.

[51] Int. Cl.[6] ..... A41D 7/00

[52] U.S. Cl. ..... 2/2.15; 2/69

[58] Field of Search ..... 2/2.15, 2.16, 2.17, 2/69, 71, 908, 455, 456, 82

[56] References Cited

U.S. PATENT DOCUMENTS

| | | | |
|---|---|---|---|
| D. 202,976 | 11/1965 | O'Neill | D3/17 |
| 1,706,097 | 3/1929 | Aud . | |
| 2,582,811 | 1/1952 | Williams | 2/2.1 |
| 3,493,972 | 2/1970 | Oldham | 2/2.1 |
| 3,763,498 | 10/1973 | Rector | 2/2.1 R |
| 4,547,904 | 10/1985 | Long et al. . | |
| 4,809,364 | 3/1989 | Lent | 2/2.1 R |
| 4,862,517 | 9/1989 | Meistrell | 2/2.1 R |
| 4,907,295 | 3/1990 | Yasuda | 2/2.1 R |
| 4,999,845 | 3/1991 | Jenks, Jr. et al. | 2/2.1 R |
| 5,768,703 | 6/1998 | Machado et al. | 2/2.15 |
| 5,806,090 | 3/1998 | Johnson | 2/2.15 |

FOREIGN PATENT DOCUMENTS

| | | |
|---|---|---|
| 1473129 | 3/1967 | France . |
| 7-6097 | 1/1995 | Japan . |

*Primary Examiner*—John J. Calvert
*Assistant Examiner*—Shirra L. Jenkins
*Attorney, Agent, or Firm*—Flehr Hohbach Test Albritton & Herbert

[57] ABSTRACT

A neck-entry wetsuit (10) with a closure loop panel (54), a collar panel (60), zipper panels (36, 38) and a back panel (26). Collar panel (60) forms an outer neck opening (80) with a cut out region that allows the outer neck opening to expand. Back panel (26) is form to ride against a person's back and itself forms part of an inner neck opening that expands to allow entry into and out of the wetsuit.

7 Claims, 11 Drawing Sheets

NECK ENTRY WETSUIT

RELATED APPLICATIONS

This application is a continuation-in-part of application Ser. No. 08/819,964, entitled "Zipperless Neck Entry Wetsuit," filed Mar. 18, 1997, now abandoned, and of continuation-in-part application Ser. No. 08/958,648, entitled "Zipperless Neck Entry Wetsuit," filed Oct. 27, 1997, which are both incorporated herein by reference.

TECHNICAL FIELD

The present invention relates to wetsuits and, more particularly, to an improved neck opening design for ease of ingress and egress.

BACKGROUND ART

The aforementioned co-pending patent applications discuss the state of the art for neck-entry wetsuits, and include a discussion Japanese Utility Model 7-6097. This patent discloses a neck-entry wetsuit with an expandable collar formed by a gusset insert that folds in on itself, but which allows both the collar and the neck region to expand when unfolded. The '648 patent application discloses a neck-entry design with a shallow cut out region confined to the upper region of the trunk. The cut out region is closed by a Velcro-type fastener, rather than a zipper, in order to improve fit and comfort of the wetsuit. While this design provides a comfortable fitting wetsuit with minimal water leakage around the neck, the design requires reinforcement at the apex of the V-shaped cut out The present design reduces stress concentrations and improves upon the ingress into and egress out thru the neck opening. Even though these co-pending patent applications disclose zipperless wetsuits, their neck-entry designs are relevant to the zippered, neck-entry design of the present invention.

DISCLOSURE OF INVENTION

Briefly described, the wetsuit of the present invention includes an inner neck opening, for entry into and out of the wetsuit, which is cut low enough and formed wide enough so that the neck opening is at or below the base of a person's neck. The upper trunk portion has a closure panel that is attached on the back side at a point below the upper edge of a back panel of the wetsuit. The closure panel forms a collar with an outer neck opening that closely conforms to a person's neck. The closure panel includes a closeable cut out region that extends from the outer neck opening down to a point below the upper edge of the back panel. In its open position, the closure panel is substantially wider than the inner neck opening and, in its closed position, closely conforms around the person's neck. The back panel is made of relatively elastic material so that the inner neck opening can expand a sufficient amount to permit entry into and out of the wetsuit through the inner neck opening, and the open position of the closure panel is sufficiently wide so as not to interfere with expansion of the inner neck opening.

Preferably, the closeable cut out region extends down to the lower trunk portion. According to an aspect of the invention, the closeable cut out region is closed by a zipper extending partially along the lower extent of the cut out region and a hook and loop fastener extending along the upper extent of the cut out region. Preferably, the zipper extends up to a point below the upper edge of the back panel.

According to another aspect of the invention, the upper edge of the back panel is formed to extend along the upper regions of the person's back and out onto the person's shoulders.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings.

While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defmed by the appended claims.

Figure 1:
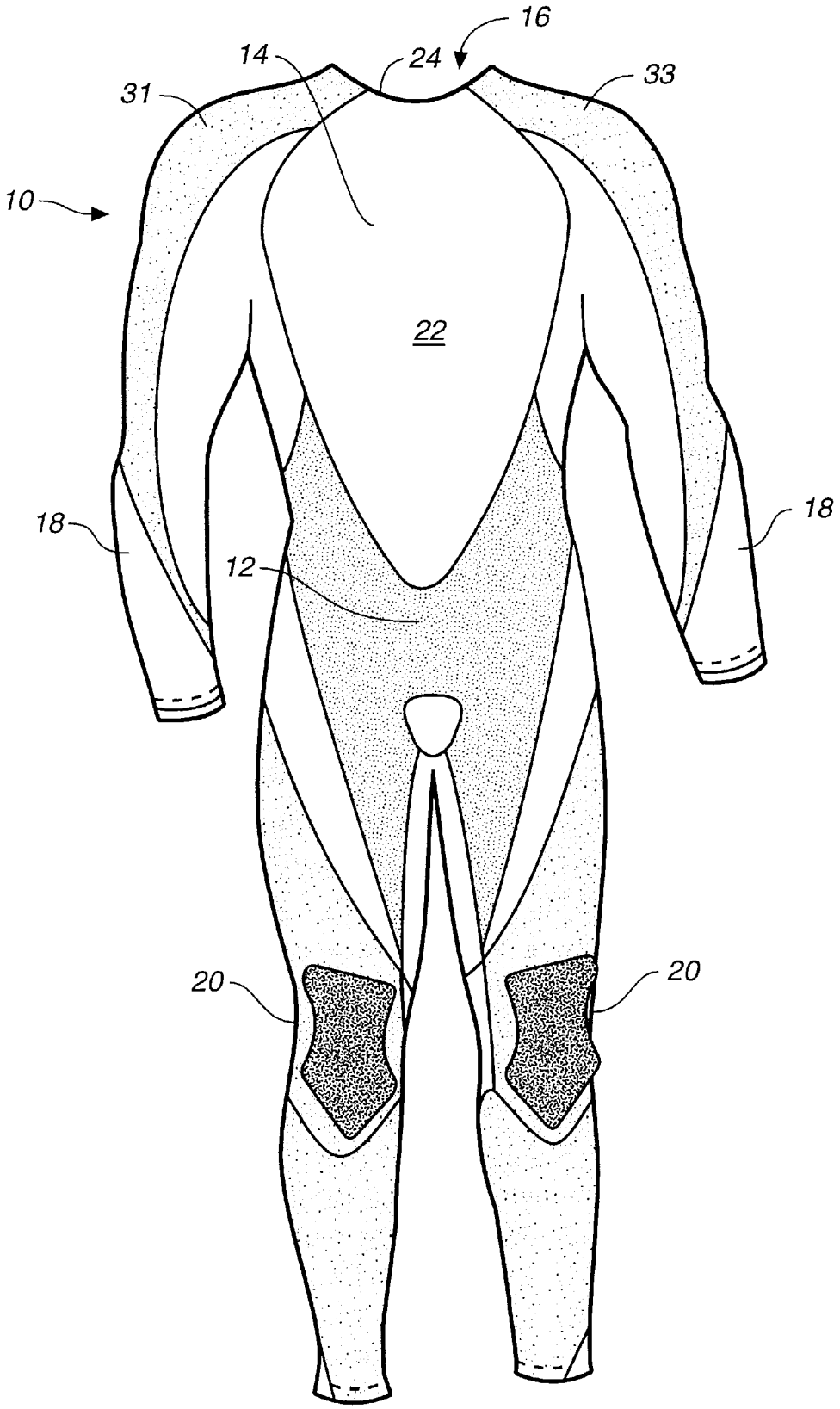
FIG. 1 is a pictorial view of the front of the wetsuit of the present invention, with the neck closure panels removed.
Figure 2:
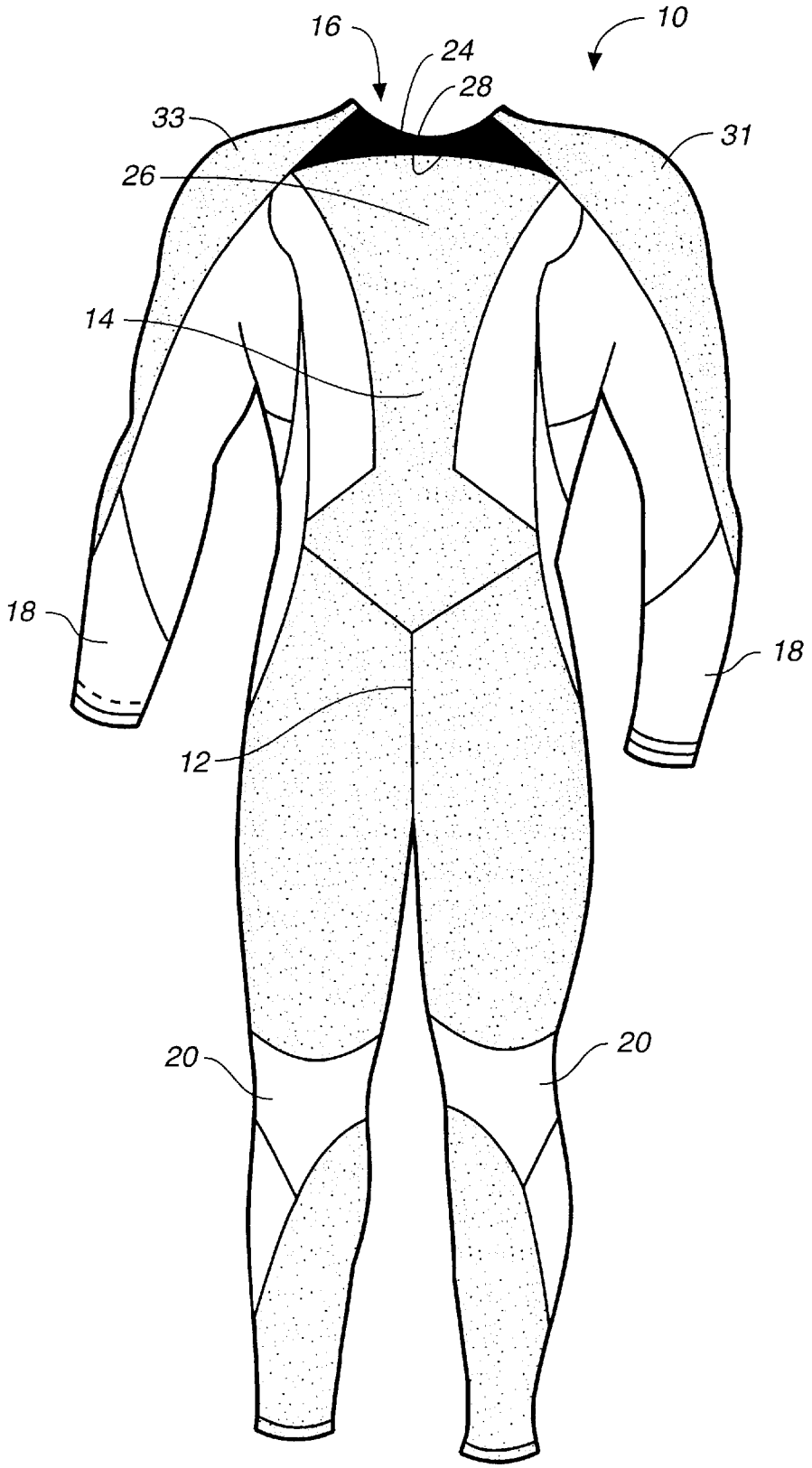
FIG. 2 is a pictorial view of the back side of the wetsuit of FIG. 1.

FIGS. 1 and 2 show front and back views, respectively, of the improved neck-entry wetsuit 10 of the present invention, with certain component pieces not shown as discussed herein. Wetsuit 10 includes a lower trunk region 12, an upper trunk region 14, a neck region 16, integral arm components 18, and integral leg components 20. The front side of wetsuit 10 includes a front panel 22 having an upper edge 24, and the back side includes a back panel 26 having an upper edge 28. A pair of shoulder panels 31, 33 form part of neck region 16 and include a common upper edge 24.

The front panel upper edge 24 rides higher than does back panel upper edge 28. In fact, back panel upper edge 28 is cut low enough and formed wide enough so that it rides at or below the base of a person's neck. It can be seen in FIG. 2 that upper edge 28 also extends laterally to shoulder panels 31, 33. As discussed in more detail later, upper edge 28 forms part of an inner neck opening of the wetsuit that can expand a sufficient amount to permit entry into and out of the wetsuit.

The present invention resides primarily in the neck region of the wetsuit and, thus, the particular design of the remaining components of wetsuit 10 can be varied from that shown in FIGS. 1 and 2. Generally, the various component pieces making up trunk regions 12, 14, neck region 32, and arm and leg components 18, 20 can be made from different types of neoprene or other suitable stretchable elastomeric or foam fabric material commonly used for wetsuits. Suitable materials include #39 Superstretch SL with 7500-10 Jersey/Mesh neoprene available from Yamamoto Corporation, Japan, Ultrastretch neoprene and Flist neoprene from Heiwa Corporation, Japan, Velcro Plush neoprene from Yamamoto Corp., and Neoprene 2DL from Sheico Corporation, Taiwan, China. It is, however, particularly advantageous to have back panel 26 and front panel 22 be made of a superstretch material to allow for sufficient expansion of the inner neck region to pass the wetsuit over a person's shoulders.

Figure 3:
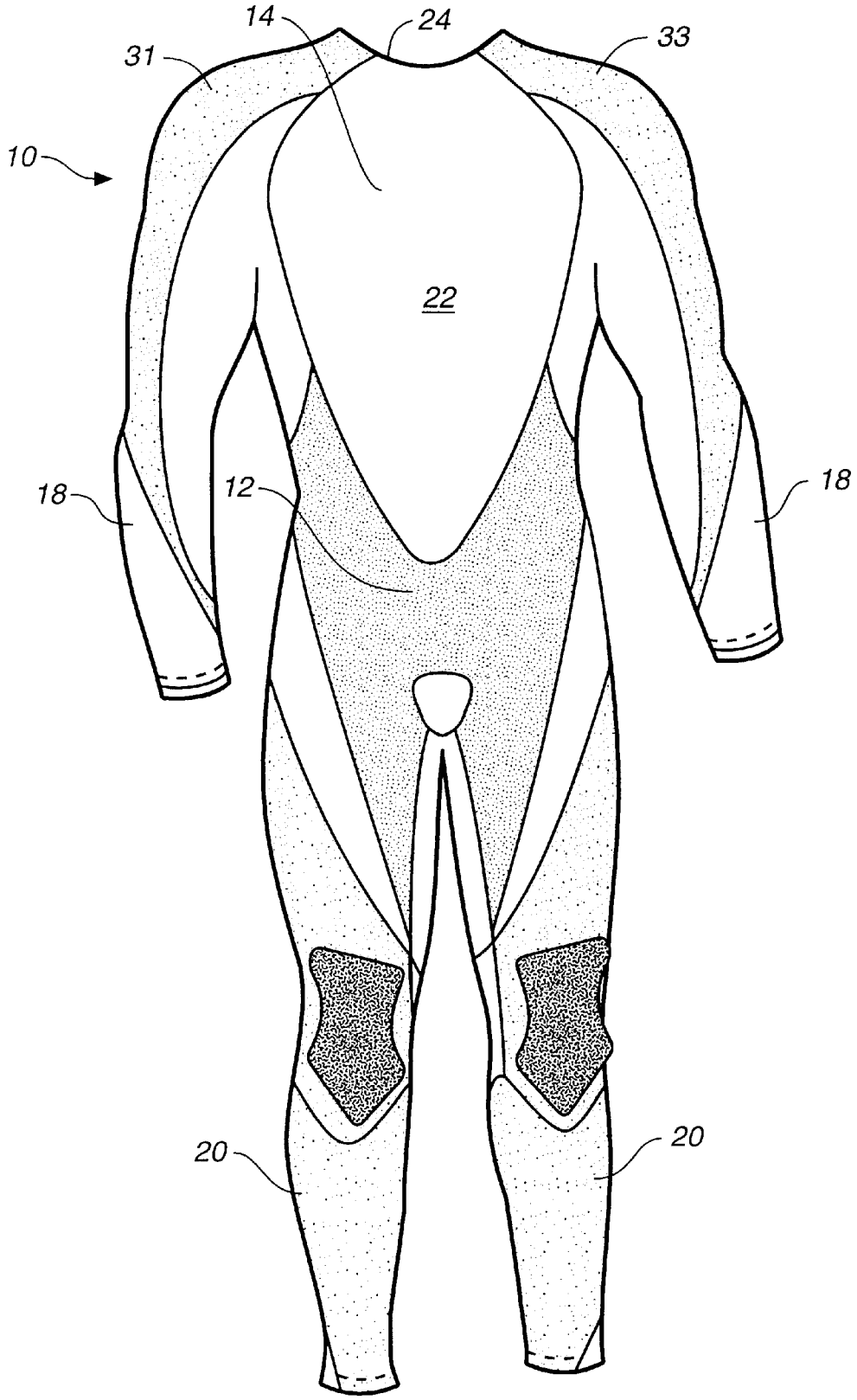
FIGS. 3 and 4 are front and back views, respectively, of the wetsuit of Fig., with zipper panels added.
Figure 4:
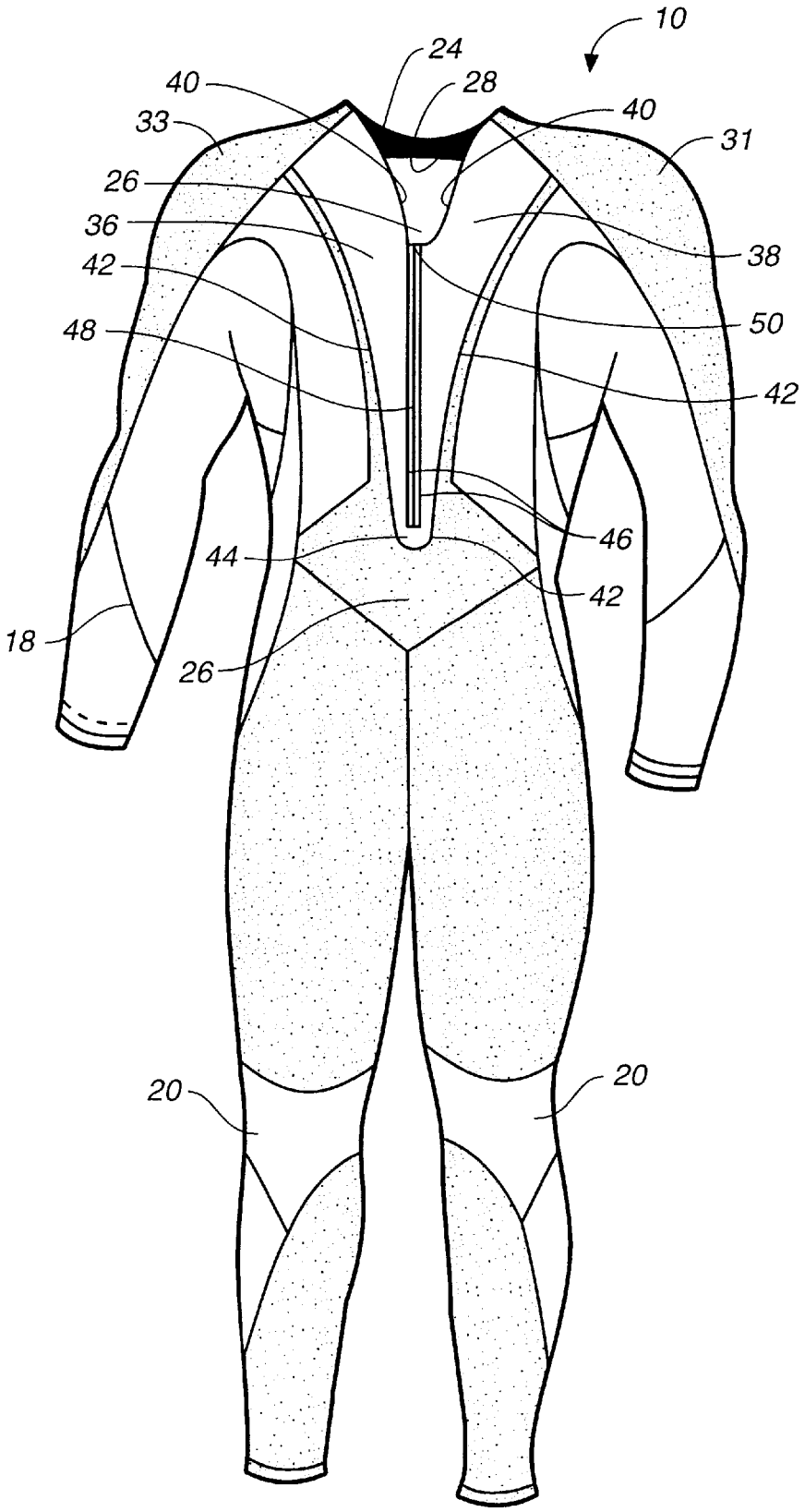

Referring to FIGS. 3 and 4, the back side of wetsuit 10 includes a pair of neck closure zipper panels 36, 38, which are attached by stitching to the back edges of shoulder panels 31,33 so that their upper edges 40 are flush with front panel upper edge 24. Zipper panels 36,38 are also attached by stitching along edges 42 to back panel 26 in a manner where panels 36,38 overlie portions of back panel 26. Zipper panels 36,38 are joined or formed integrally with each other at point 44 in the lower trunk region 12 of the wetsuit. Zipper panels 36,38 include inner edges 46 to which is sewn a zipper 48. Zipper 48 terminates at point 50, which is below back panel upper edge 28 and preferably substantially below, as shown in the figure.

Figure 5:
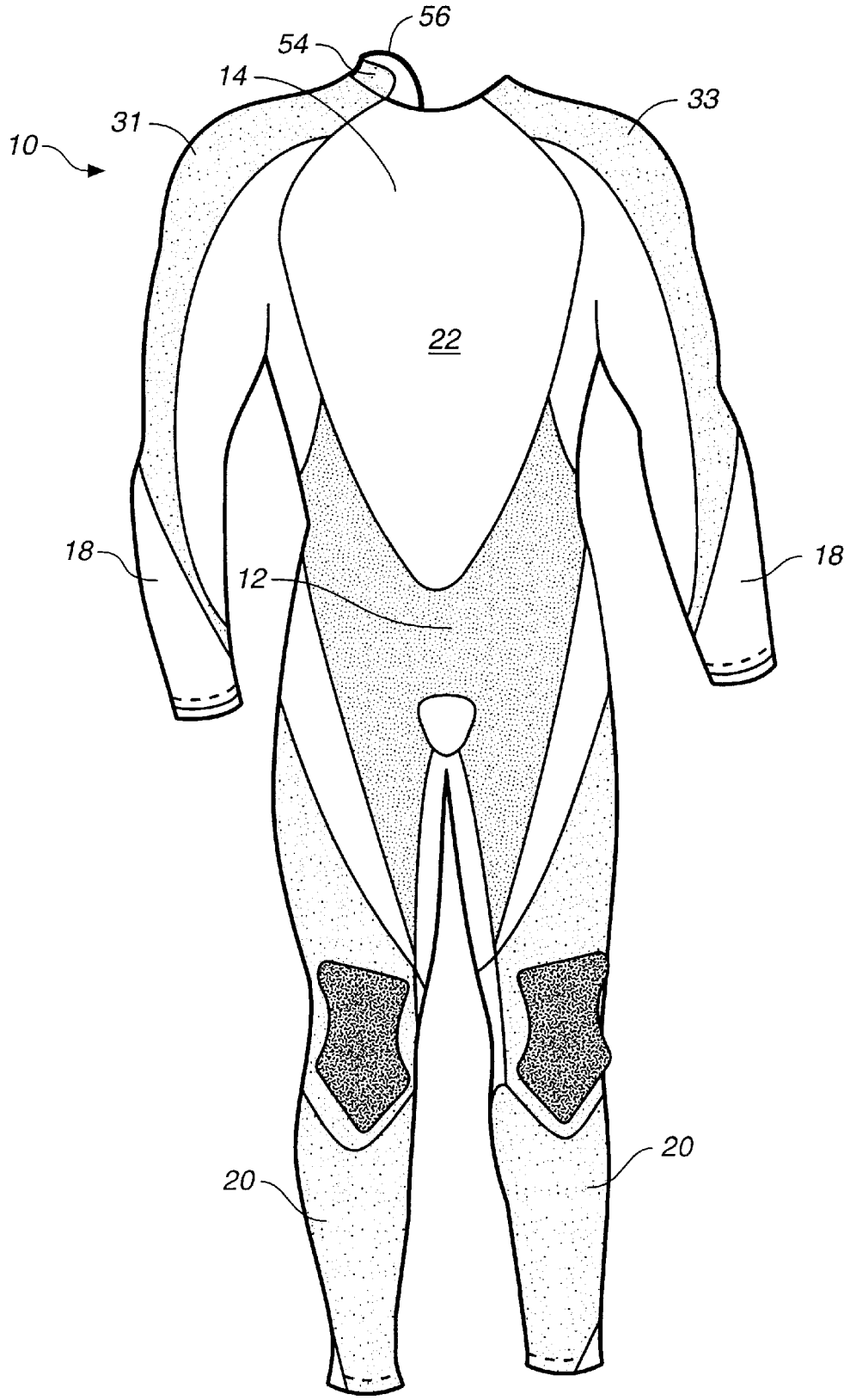
FIGS. 5 and 6 are front and back side views, respectively, of the wetsuit of FIG. 1, with a neck closure loop panel added.
Figure 6:
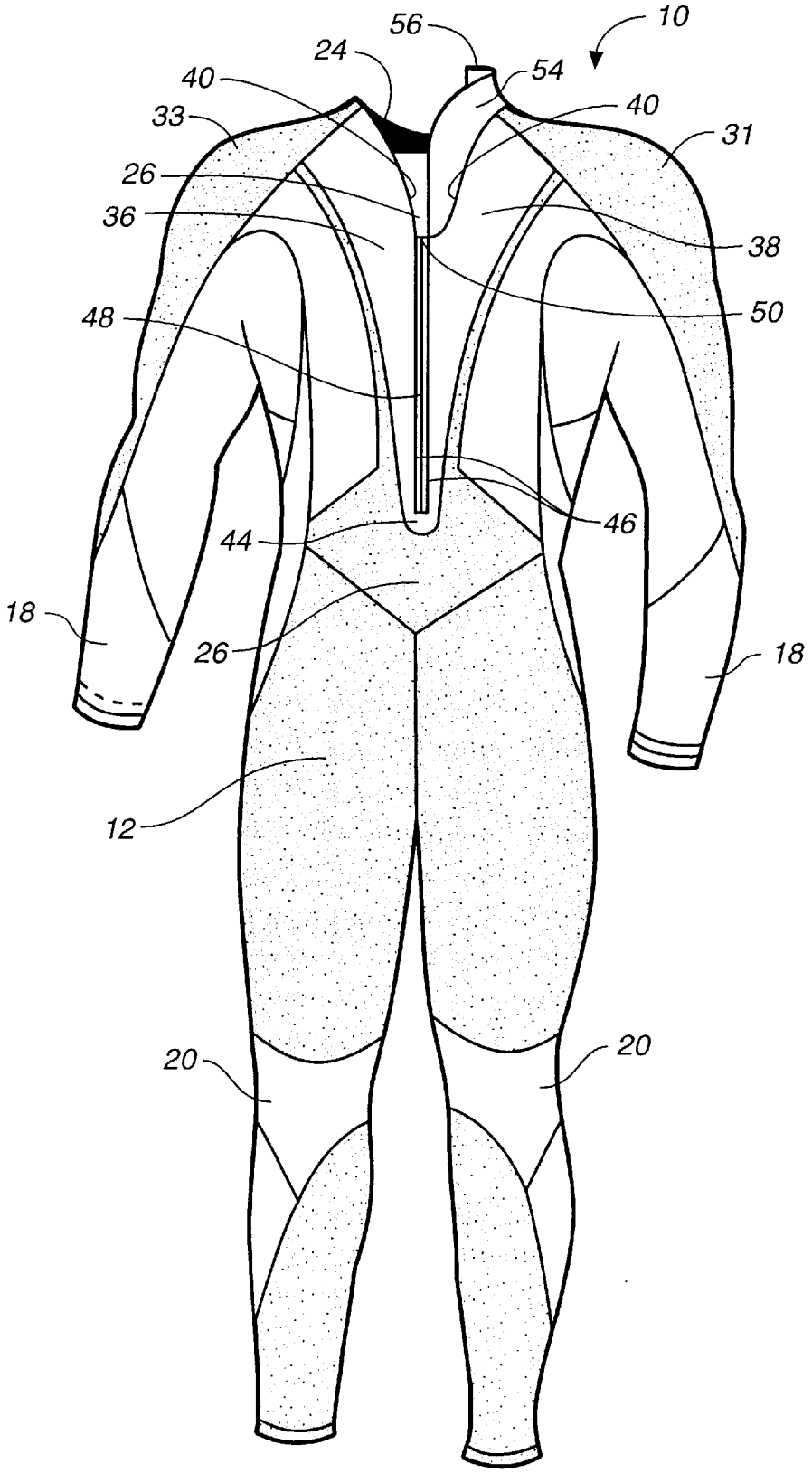

Referring to FIGS. 5 and 6, the right side of wetsuit 10 includes an exterior neck closure loop panel 54 that is attached by stitching to shoulder panel 31 and to zipper panel 38 along upper edge 40. Closure loop panel 54 extends down to point 50 at the upper end of zipper 48 and includes an upper edge 56 that forms part of an outer neck opening that is discussed in more detail later. Closure loop panel 54 has on its exterior surface Velcro-type loops that are used to create a seal from zipper 48 up to the outer neck opening. Closure loop panel 54 partially overlies back panel 26, as discussed later, can be displaced from back panel 26 in order to provide sufficient room to allow the back panel to expand.

Figure 7:
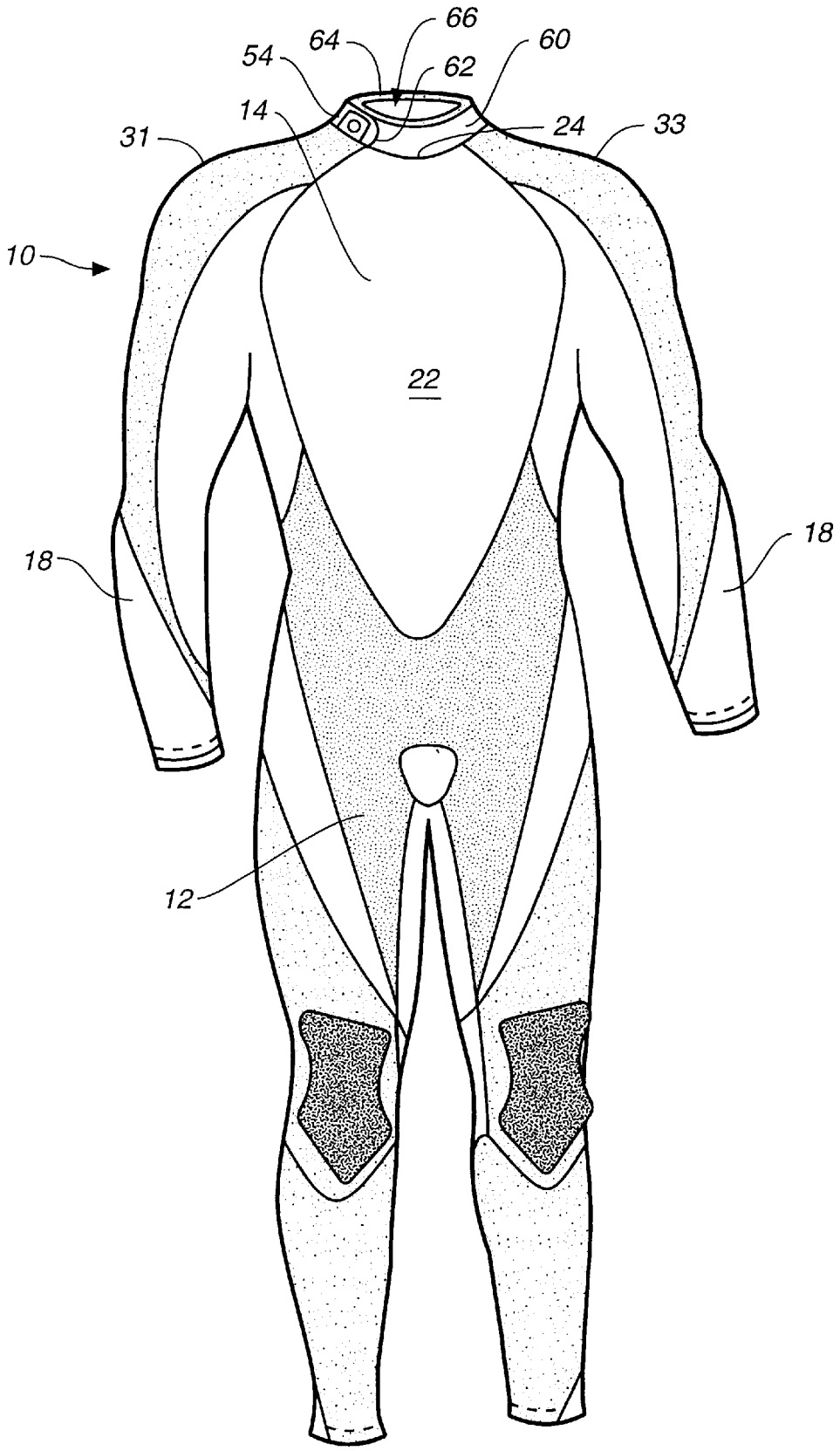
FIGS. 7 and 8 are front and back side views, respectively, of the wetsuit of FIG. 1, with a neck closure collar panel added.
Figure 8:
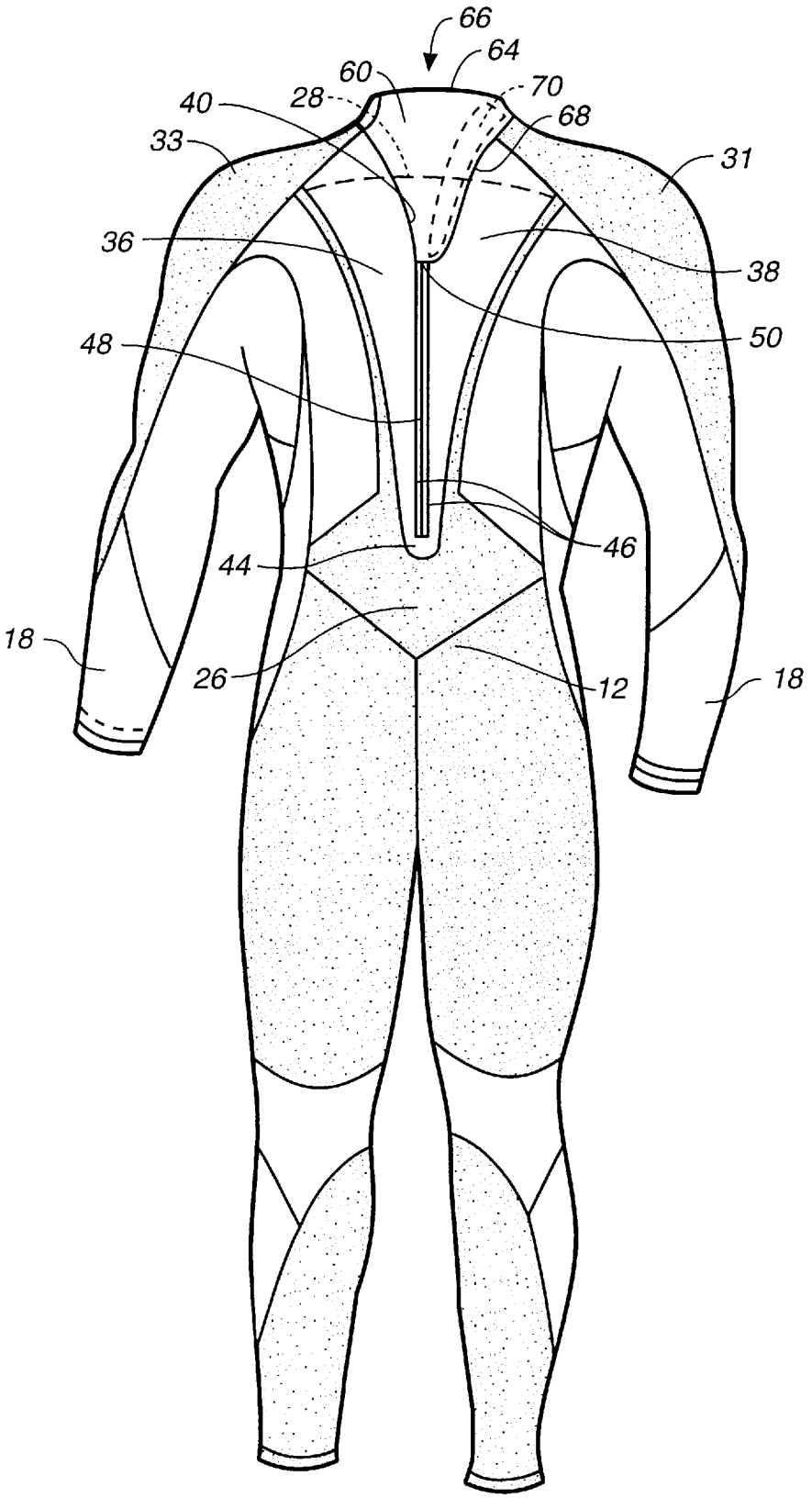

Referring to FIGS. 7 and 8, the neck region of wetsuit 10 further includes an exterior neck closure collar panel 60 that extends around the entire neck region to form outer neck opening 66 and is attached by stitching to the front edge 62 of the closure loop panel, to upper edge 24 of front panel 22 and to the upper edge 40 of zipper panel 36. Collar panel 60 includes an upper edge 64 that, together with the upper edge of the closure loop panel, defines outer neck opening 66. Collar panel 60 also includes an overlay section 68, on the underside of which is secured an interior Velcro-type hook panel 70, which interlocks with the closure loop panel to seal the upper portion of the wetsuit. Overlay section 68 lies over the closure loop panel and provides a seal from neck opening 66 down to the upper point 50 of zipper 48.

As discussed more later, zipper 48 and the overlying sections of collar panel 60 and the closure loop panel form what is termed a "cut out region," which allows for separation of collar panel 60 from the closure loop panel and separation of the zipper panels 36, 38, so that they can be opened up to provide access to the inner neck opening.

Figure 9:
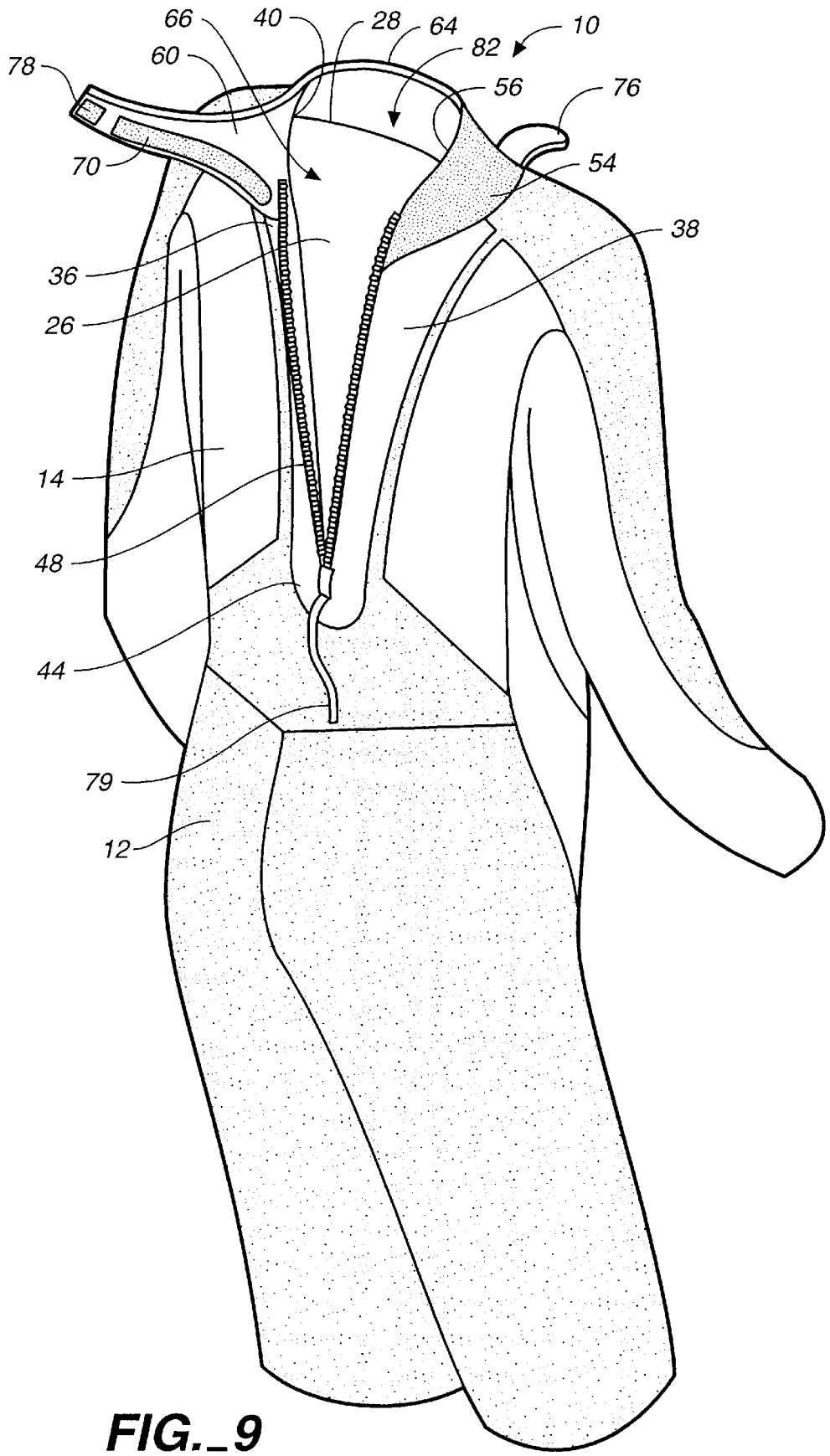
FIG. 9 is a pictorial view of the wetsuit of FIG. 1, with limb segments not shown, with the collar panel and zipper panels open.

Referring to FIG. 9, wetsuit 10 also includes a tab closure 76 that is stitched into the seam between collar panel 60 and closure loop panel 54 and which includes a loop pile on its inside surface. Collar panel 60 also includes a short hook piece 78 that is secured around the outer end of collar panel 60 with a portion of its hooks facing outwardly. In addition, zipper 48 includes a pull cord 79.

In FIG. 9, collar panel 60 is shown in an open position, separated from closure loop panel 54, and zipper 48 is shown unzipped with zipper panels 36,38 separated. In this position, the outer neck opening, indicated by arrow 66, is defined by the front side of upper edge 64 and by upper edges 40, 56, down to bottom of zipper 48, adjacent point 44. The inner neck opening is indicated by arrow 82 and it is defined by the front side of upper edge 64 and by the upper edge 28 of back panel 26. With zipper 48 unzipped and collar panel 60 separated from closure loop panel 54, outer neck opening 66 is substantially expanded, which allows inner neck opening 82 to expand a sufficient amount to permit entry into and out of the wetsuit. In other words, the open position of the collar panel and zipper is sufficiently wide so as not to interfere with expansion of the inner neck opening.

The open position of collar panel 60 and zipper 48 illustrate the cut-out region that extends from the upper edge 64 of collar panel 60 down to a point below the upper edge 28 of back panel 26 and preferably substantially below to provide sufficient expansion of the outer neck opening, which in turn provides sufficient room for expansion of the inner neck opening.

Figure 10:
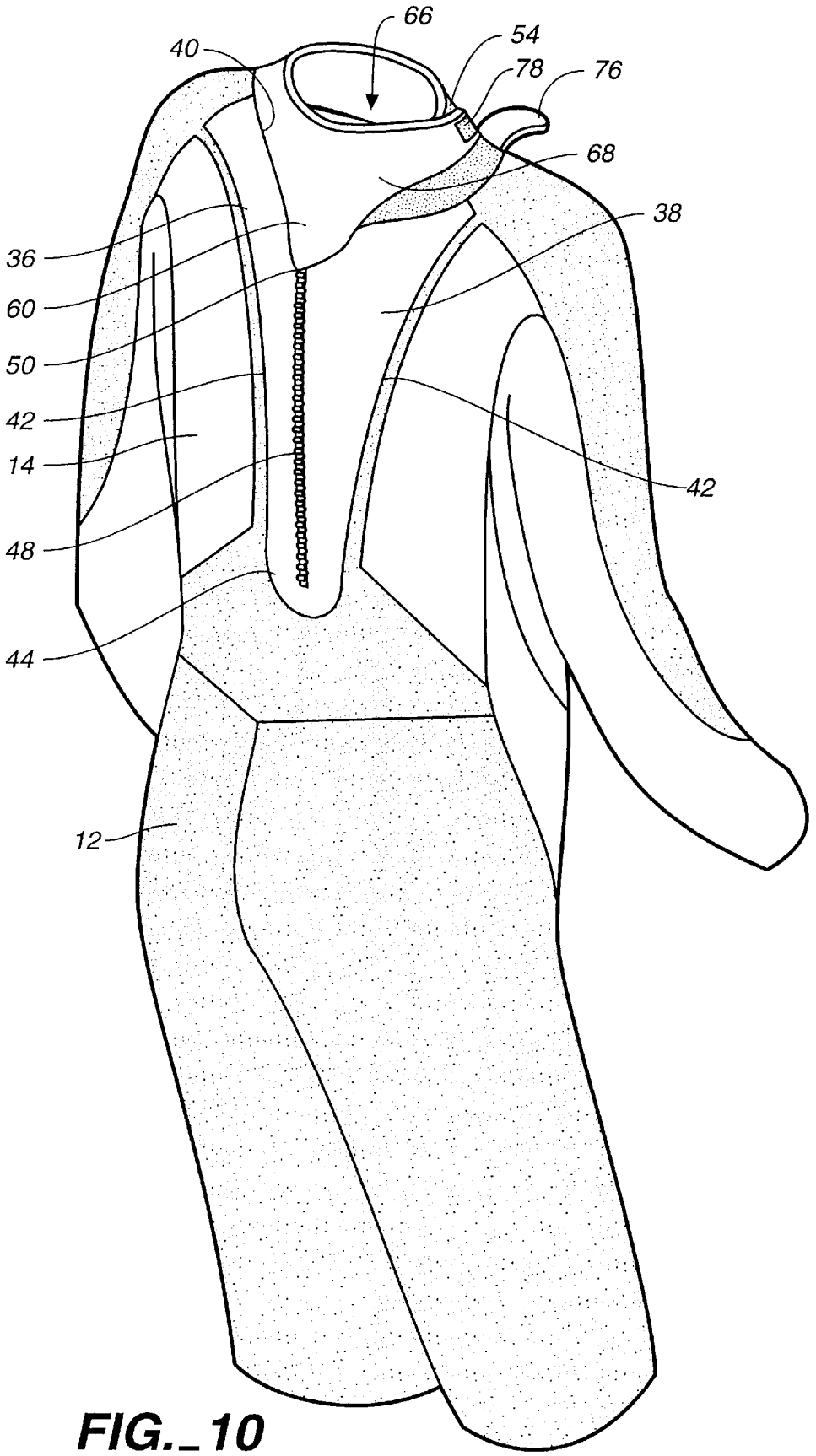
FIG. 10 is a pictorial view like FIG. 9 with the zipper and collar panels closed.
Figure 11:
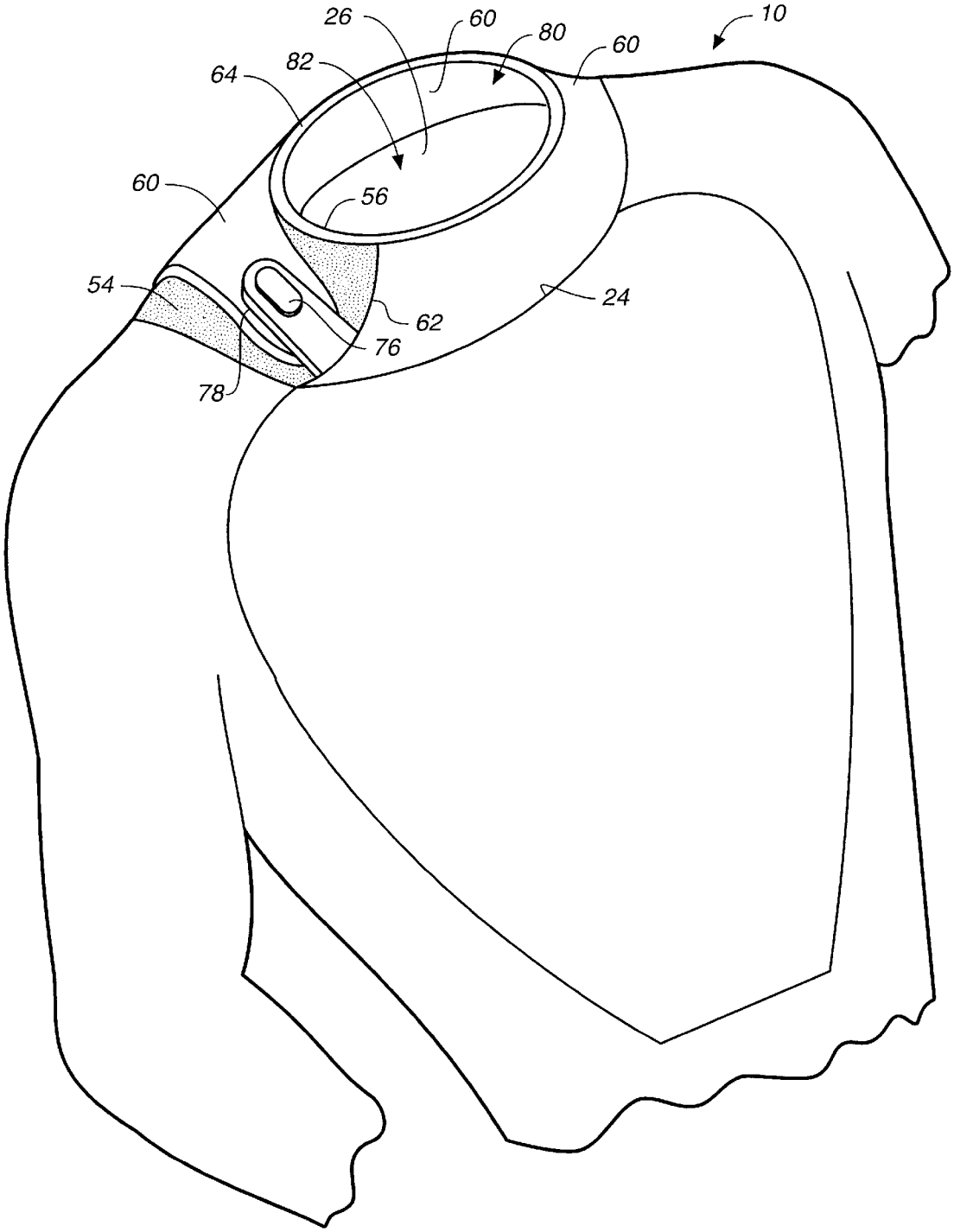
FIG. 11 is a pictorial view of the front of the wetsuit with the zipper and collar panels closed.

Referring to FIGS. 10 and 11, collar panel 60 is closed and zipper 48 zipped up. Tab closure 76 is in position to close against in overlapping fashion the outer end of collar panel 60, which is shown in FIG. 11. In its closed position, collar panel 60 closely conforms to the person's neck in a manner minimizing water entry through the outer neck opening. Back panel 26 lies against the upper portions of the person's back and seals off the person's back below the shoulder region. Should any water leak into the wetsuit through the zipper or through the Velcro-type fastener between collar panel 60 and closure loop panel 54, back panel 26 keeps the water away from the person's body.

Zipper 48 and the Velcro-type fastener at the junction of collar panel 60 and closure loop panel 54 create the cut out region that extends from the outer neck opening down to a point at least below the upper edge of the back panel and preferably down to the midpoint of the upper trunk region or down into the lower trunk region.

In the claims, the term "closure panel" is used to mean a panel like collar panel 60 that forms part of the outer neck opening and which is secured to the back panel at a point below the upper edge of the back panel, as is collar panel 60, so that in an open position provides sufficient access to the inner neck opening. In a narrower sense, the zipper panels 36, 38 also form part of the closure panel, but it is not necessary for the zipper panels to extend down as far as shown in order to create a sufficiently wide outer neck opening.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A wetsuit comprising, an upper trunk portion having integral arm components, and a lower trunk portion having integral leg components, the upper trunk portion including a back panel that partially defines an inner neck opening for entry into and out of the wetsuit, the inner neck opening being cut low enough and formed wide enough on the back side of the upper trunk portion so that the neck opening is at or below the base of a person's neck, the upper trunk portion further including a closure panel attached on the back side at a point below the upper edge of the back panel, the closure panel forming a collar with an outer neck opening that closely conforms to a person's neck, the closure panel including a closeable cut out region extending from the outer neck opening down to a point below the upper edge of the back panel, the closeable cut out region giving the closure panel an open position that is substantially wider than the inner neck opening and a closed position that closely conforms the closure panel around the person's neck, the back panel being made of relatively elastic material so that the inner neck opening can expand a sufficient amount to permit entry into and out of the wetsuit through the inner neck opening, the open position of the closure panel being sufficiently wide so as not to interfere with expansion of the inner neck opening.

2. The wetsuit of claim 1 wherein, the closeable cut out region extends down to at least the midpoint of the upper trunk portion.

3. The wetsuit of claim 2 wherein, the closeable cut out region extends down to the lower trunk portion.

4. The wetsuit of claim 1 wherein, a front panel and the back panel closely conform to the contours of the person's upper body.

5. The wetsuit of claim 1 wherein, the upper edge of the back panel is formed to extend along a upper regions of the person's back and out onto the person's shoulders.

6. The wetsuit of claim 1 wherein, the closeable cut out region is closed by a zipper extending partially along a lower extent of the cut out region and a hook and loop fastener extending along a upper extent of the cut out region.

7. The wetsuit of claim 6 wherein, the zipper extends up to a point below the upper edge of the back panel.

* * * * *